US005727716A

United States Patent [19]

Hochstein et al.

[11] Patent Number: 5,727,716

[45] Date of Patent: Mar. 17, 1998

[54] DEVICE FOR OPERATING PUMP SPRAYS

[75] Inventors: Andreas Hochstein, Bruchsal; Reiner Reeg, Pforzheim, both of Germany

[73] Assignee: Goldwell GmbH, Germany

[21] Appl. No.: 602,974

[22] Filed: Feb. 16, 1996

[30] Foreign Application Priority Data

Mar. 30, 1995 [DE] Germany ..... 195 11 638.0

[51] Int. Cl.[6] ..... B65D 88/54

[52] U.S. Cl. ..... 222/321.8

[58] Field of Search ..... 222/321.8, 509, 222/570, 402.13

[56] References Cited

U.S. PATENT DOCUMENTS

| | | | |
|---|---|---|---|
| 3,542,257 | 11/1970 | Parish | 222/509 |
| 4,077,548 | 3/1978 | Beard | 222/321.8 |
| 4,264,038 | 4/1981 | Nozawa | 222/321.8 X |
| 4,807,786 | 2/1989 | Gueret | 222/509 X |
| 5,139,180 | 8/1992 | Lucas | 222/509 X |

FOREIGN PATENT DOCUMENTS

| | | |
|---|---|---|
| 2612774 | 10/1976 | Germany . |
| 8913647 | 5/1991 | Germany . |

*Primary Examiner*—Gregory L. Huson
*Attorney, Agent, or Firm*—Londa and Traub LLP

[57] ABSTRACT

A device for operating pump sprays with actuators in central position and to provide ease of handling, having a fixable support on the pump spray container, two actuating levers arranged to move in plane, and a connecting piece fixed below the axis of rotation of the actuating levers. The connecting piece comprises at least one flexible part being a central part projecting in the direction toward the actuator and keeping contact with the actuator while not in use.

9 Claims, 2 Drawing Sheets

DEVICE FOR OPERATING PUMP SPRAYS

BACKGROUND

This invention is directed to a device for operating a pump spray having the spraying actuator in the central position.

Pump sprays are used for atomizing all sorts of liquids. They are commonly equipped with centrally positioned actuators and usually operated by depressing the actuator with a finger. Since a large amount of force is often necessary for the delivery operation, it is difficult to actuate the pump button with the finger tips, particularly for feeble users.

Pump sprays are also known that have a lever as an operating device, where the bottle top and lever are both held and operated by one hand. In this instance, however, the actuator is costly and bulky. Therefore, these pump sprays are mainly used for the spraying of household liquids and for flower sprays.

It is the object of this invention to develop a device for operating pump sprays, where the spray nozzle is located in a central position and which makes the handling of the pump spray easier.

This problem is solved by a device for operating a pump spray which has an actuator in a central position of the container. The device comprises a support which can be fixed on the pump spray container, and two actuating levers arranged to move in a plane. At least one flexible piece is set below the axis of rotation of the actuating levers which connects the actuating levers with each other. The connecting piece has a central part projecting towards the actuator and is in contact with the actuator even when the actuator is not being used.

BRIEF DESCRIPTION OF THE DRAWINGS

The following examples illustrate the invention by drawings.

DETAILED DESCRIPTION

Figure 1:
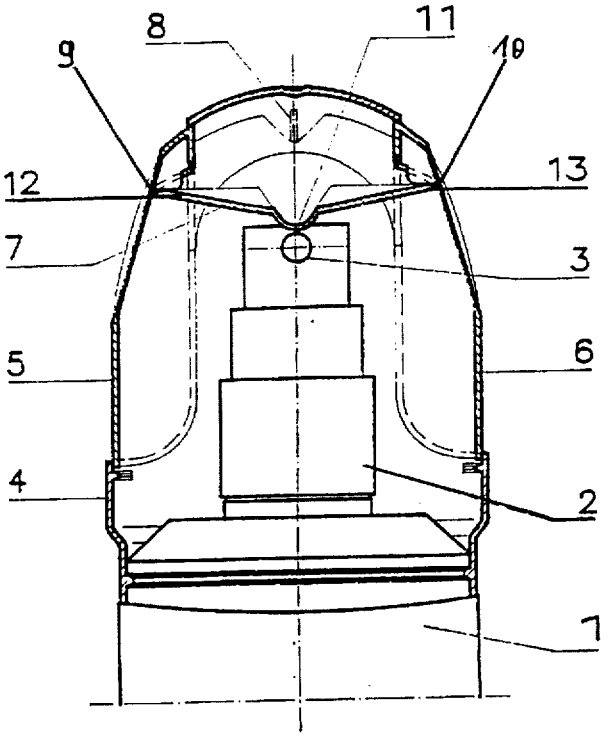
FIG. 1 shows the upper part of a pump spray device in a cross-sectional view, presenting the spray actuator in starting position.

Referring to FIG. 1, the pump spray device in the form of a can (1) comprises an actuator (2) with a spray nozzle (3) in the central position of the container, has a slip-on cap (4). The cap (4) is detachable from the can (1) in any known way, e.g., as a ring-shaped groove and spring joint.

A handle arrangement consisting of two actuating levers (5,6) is placed inside the cap (4), which may be moved toward or away from each other in a plane, and which has a connecting piece (7) joined thereto that also moves. In the example illustrated in FIG. 1, the actuating levers (5) and (6) are depicted as articulated levers which are inter-connected by a hinge (8). The levers are preferably made of plastic material so that the hinge (8) may also be made of plastic material by shaping or attenuating the plastic into a thin-film hinge. FIG. 1 shows the actuating levers (5,6) linked to the connecting piece (7) at the inflections (9,10).

According to FIG. 1, the connecting piece (7) has an almost V-shaped design, the central part (11) thereof forming a projecting tip. The central part (11) of the V-shaped connecting piece (7) may be rigid or inflexible, while its two shanks (12,13) are flexible. However, the shanks (12,13) may also be inflexible and interlinked by a hinge as central part (11) to enable them to turn towards each other.

The connecting piece (7) may also be provided as a flexible curve-shaped section and, e.g., consist of a curved plate spring. The curved connecting piece may have any form, but it must ensure a movement of its central part in one direction only upon exposure of pressure onto its ends, i.e., towards the spray actuator.

Figure 2:
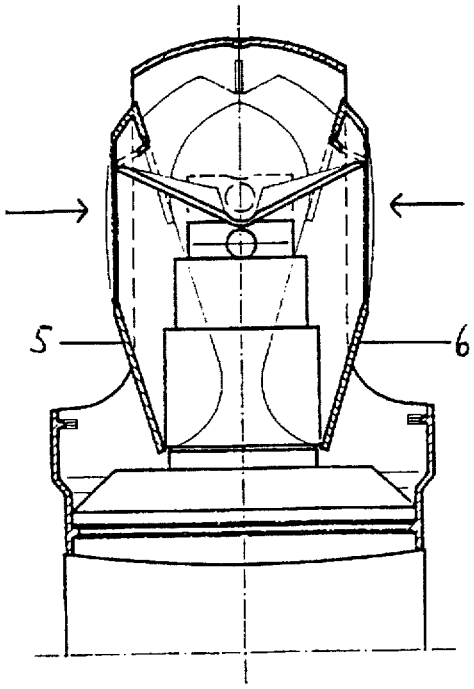
FIG. 2 shows a section of FIG. 1 in spraying position.

The operative device works as follows (see FIG. 2).

When pressing the actuating levers (5,6) in the direction of the arrows, e.g., with thumb and forefinger of one hand, the actuating levers are moved towards each other and the square hinge is deformed because hinge (8) pushes against the cap (4) serving as a support so that the central part (11) is pressed downward thereby releasing a pumping movement in the actuator (2) to discharge the liquid from the spray container through nozzle (3). In its terminal position, i.e., when the two actuating levers (5,6) are in their nearest possible position, the pressure on the actuating levers (5,6) is released, and by the action of the actuator (2) moving into its initial position, optionally supported by a spring action of the connecting piece (7), the actuating levers (5,6) and the actuator (2) return to their initial position.

By modifying the position of the pivotal points of the connecting piece (7) to the actuating levers (5,6) (i.e., a change of the lever arms), the pressure exerted by the fingers may be changed. Instead of designing a combined hinge (8), it is also possible to fasten the actuating levers (5,6) separately from each other at the supporting means (not illustrated) or to provide a spacer between them where they are linked (not illustrated). For example, the connecting piece (7) may be joined by snap links with the actuating levers (5,6), however, it is also possible to produce it in one piece by attenuation of the material (e.g., as a film hinge) with the actuating levers (5,6).

Figure 3:
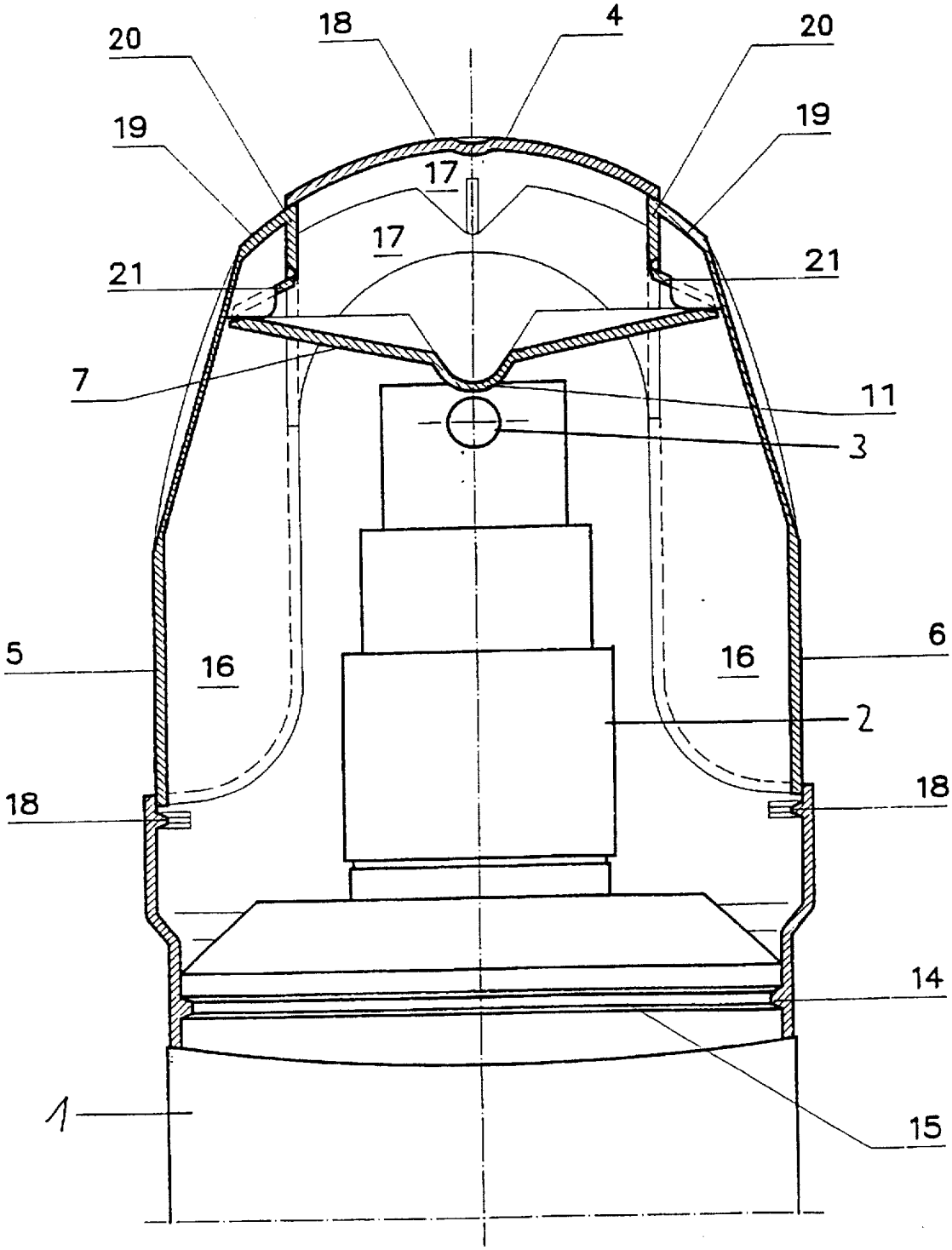
FIG. 3 shows a practical example of the operating device mounted in a cap of the pump spray device.

The embodiment illustrated in FIG. 3 shows a pump spray container (1) with centrally positioned actuator (2), a spray nozzle (3), and a cap (4). At its lower end, the cap (4) has an inside ring-projection (14) which may be introduced into a corresponding ring groove (15) of the container (1).

The cap (4) has two opposite recesses (16) intended for the passage of the actuating levers (5,6) and for their horizontal swing movement, and also a spray outlet not shown in the drawing and, in its upper part, two wall parts (17) defining a groove.

In this groove, a part of the handle arrangement is placed non-rotatably, thus the actuating levers (5,6) always remain within the recesses (16); for this purpose the actuating levers (5,6) may optionally also include a spacer or guide parts, e.g. in the form of ribs or guide rods (not illustrated).

Below the recesses (16) ring projections are provided, between which and the cap top (18) the levers are placed.

The arrangement of the levers comprises two articulated levers (5,6) linked to an upper part (19) each, having a radius of curvature which corresponds with the interior radius of curvature inside the cap top (18).

The free end of the upper part (19) is connected to a flange (20) to which the connecting piece (7) is linked at its lower end by a hinge part (21). The central part (11) of the connecting piece (7) is designed as a curve-shaped part with a hinge. The hinge part (21) enables the ends of the connecting piece (7) to be arranged in the contact area of the levers (5,6). When the levers (5,6) are pressed towards each other, the force is immediately transmitted onto the connecting piece (7), thereby its central part (11) giving way downward, releasing the pumping action whereby the cap top (18) acts as abutment.

What is claimed is:

1. A device for operating a pump spray on a container having a spray actuator in a central position, in the form of a container cap, comprising:

a support, for detachably fixing the device on the pump spray container;

at least two vertical actuating levers disposed on opposite sides of the support and movable in a plane in a direction towards each other and about an axis of rotation, said actuating levers having upper ends connected by a flexible hinge member located above the axis of rotation, a connecting piece linked to the upper ends of the actuating levers, the connecting piece comprising at least one flexible shank provided below the axis of rotation of the actuating levers, and a central projecting part for contacting the actuator, wherein pressure exerted by a user of the spray container on the actuating levers in the plane of direction towards each other causes the connecting piece to deform whereby the central projecting part in contact with the actuator forces the actuator downward, thereby effectually operating the pump spray.

2. The operating device according to claim 1, wherein the hinge comprises an attenuation of the material forming the actuating levers.

3. The operating device according to claim 1, wherein the connecting piece has a V-shape with flexible elastic shanks.

4. The operating device according to claim 1, wherein the connecting piece comprises two flexible inter-connected guide rods.

5. The operating device according to claim 1, wherein the connecting piece comprises a flexible elastic curve-shaped part.

6. The operating device according to claim 1, wherein the support comprises a cap provided with recesses for the actuating levers and an outlet of the spray.

7. The operating device according to claim 6, wherein the actuating levers a handle arrangement and the connecting piece, and is placed into the cap.

8. The operating device of claim 1, wherein the connecting piece comprises two flexible shanks and wherein the central projecting part is inflexible.

9. The operating device of claim 8, wherein the connecting piece comprises a V-shape.

* * * * *